United States Patent [19]

Jäger et al.

[11] Patent Number: 4,581,852

[45] Date of Patent: Apr. 15, 1986

[54] HEAT-INSULATED WINDOW CASEMENT AND FRAME CONSTRUCTION

[75] Inventors: Tilo Jäger; Armin Tonsmann, both of Bielefeld; Siegfried Habicht, Leopoldshohe; Eitel Höcker, Bielefeld, all of Fed. Rep. of Germany

[73] Assignee: Schuco Heinz Schumann GmbH & Co., Bielefeld, Fed. Rep. of Germany

[21] Appl. No.: 606,444

[22] Filed: May 3, 1984

[30] Foreign Application Priority Data

May 6, 1983 [DE] Fed. Rep. of Germany ..... 3316623

[51] Int. Cl.[4] ..... E06B 3/00

[52] U.S. Cl. ..... 49/501; 49/401; 52/309.13; 52/731

[58] Field of Search ..... 52/731, 309.13; 49/501, 49/401

[56] References Cited

U.S. PATENT DOCUMENTS

| | | | |
|---|---|---|---|
| 3,798,869 | 3/1974 | Nipp | 52/731 X |
| 4,221,355 | 9/1980 | Hoop | 248/340 |
| 4,333,283 | 6/1982 | Ebata | 49/63 X |
| 4,359,805 | 11/1982 | Berneke | 16/364 |

FOREIGN PATENT DOCUMENTS

| | | | |
|---|---|---|---|
| 2406943 | 8/1974 | Fed. Rep. of Germany | 49/401 |
| 2755695 | 6/1979 | Fed. Rep. of Germany | 52/731 |
| 2905191 | 8/1980 | Fed. Rep. of Germany | 52/731 |
| 2911832 | 10/1980 | Fed. Rep. of Germany | 52/731 |
| 2919437 | 11/1980 | Fed. Rep. of Germany | 52/731 |
| 8001820 | 9/1980 | United Kingdom | 49/DIG. 1 |

*Primary Examiner*—Alfred C. Perham
*Assistant Examiner*—Jean M. LaKemper
*Attorney, Agent, or Firm*—Sprung Horn Kramer & Woods

[57] ABSTRACT

A composite section that the frames of a window or a door are made out of or that are used to construct a facade consist of a plastic rail section and of a metal rail section. The metal rail sections face inward when the composite section is employed to construct a window or a door frame, whereas the plastic rail sections constitute the outer shell. The plastic rail section has anchoring webs with free edges that engage recesses in the metal rail sections. The anchoring webs are secured in the recesses because the outer recess webs and/or inner recess webs conform to the shape of the anchoring webs. The plastic rail sections are angular in cross-section and have outer flanks that in the case of a window or door constitute motion-limiting webs or glass-securing strips. The fittings that connect the casement to the window frame and the fittings that anchor the window frame are attached only to the metal rail sections.

2 Claims, 1 Drawing Figure

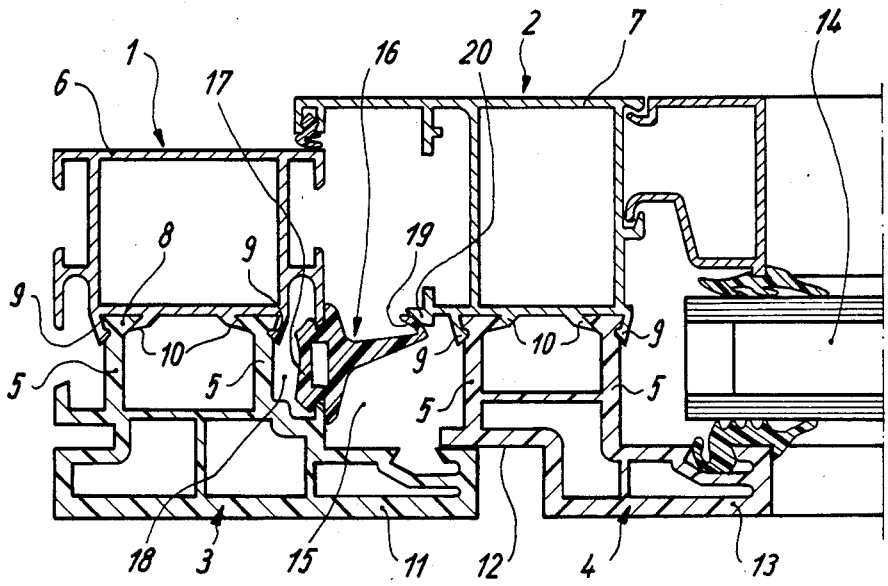
1
2
3
4
5
6
7
8
9
10
11
12
13
14
15
16
17
18
19
20

HEAT-INSULATED WINDOW CASEMENT AND FRAME CONSTRUCTION

BACKGROUND OF THE INVENTION

The present invention relates to a window or door with a heat-insulated casement and a heat-insulated window frame made out of metal and plastic rail sections. It also relates to a heat-insulated composite section for manufacturing a window, door, or facade.

Windows and doors of the aforesaid type are known. The casement and window-frame struts are made out of heat-insulated composite sections that consist of two metal rail sections and one or more plastic insulating strips or plastic rail sections. The insulating strips or plastic rail sections are positioned between the metal rail sections that constitute the outer and inner shell of the strut. Since the metal rail sections are usually made out of aluminum, the outer aluminum shell assumes a temperature that matches the outside temperature. The heat-insulation value of the composite section is negatively affected by radiation or convection in the vicinity of the bond. When the heat-insulated composite sections have two parallel insulating strips, parts of the light-metal outer and inner shell face each other between the insulating strips. Air moves in the resultingly large hollow spaces in the vicinity of the bond and transfers heat.

SUMMARY OF THE INVENTION

The object of the present invention is to provide a window, a door, or a heat-insulated composite section of the aforesaid type with improved heat insulation and fewer rail sections to be attached together.

This object is attained in accordance with the invention in that the struts in the frame of the window or door consist of a plastic rail section on the side facing out and of a metal rail section on the side facing in, in that the plastic rail sections have anchoring webs secured in recesses in the metal rail section and constituting a limit to the motion between the casement and the window frame, and in that the connecting fittings are attached only to the metal frame of the casement and window frame.

Positioning the plastic rail section on the outside results in direct insulation with respect to the outside air.

The metal rail sections facing the inside constitute in the case of windows and doors a supporting frame at which, to the extent that the frame is part of the window frame, attachment to the masonry can occur. The fittings that connect the casement to the window frame are attached to the metal rail sections so that the transmission of force from the casement to the window frame through the fittings and thence to the masonry will be unexceptionable.

The composite section in accordance with the invention consists exclusively of a metal rail section and a plastic rail section. They are connected halfway into the section. The plastic rail section has two parallel, separated anchoring webs that have anchoring projections or anchoring strips along their free longitudinal edges. The free longitudinal edges of the anchoring webs are secured in recesses in the metal rail sections by making the shape of the outer and/or inner recess webs conform to that of the anchoring webs.

BRIEF DESCRIPTION OF THE DRAWING

A preferred embodiment of the invention will now be described with reference to the attached drawing wherein, The FIGURE is a horizontal section through a window with both casement and window frame constructed out of heat-insulated composite sections.

DETAILED DESCRIPTION OF THE PREFERRED EMBODIMENTS

The struts of window frame 1 and of casement 2 have a plastic rail section 3 and 4 on the outside that has two parallel anchoring webs 5 that connect it to a rail section 6, 7 facing inwardly. The free edges of anchoring webs 5 have anchoring strips 8 or anchoring projections that engage recesses in the metal rail sections formed by webs 9 and 10. The free longitudinal edges of anchoring webs 5 are secured in the recesses in the metal rail sections because the outer recess webs 9 and inner recess webs 10 conform to the shape of anchoring webs 5. Plastic rail section 3 is angular and has an outer flank 11 in the form of a motion-limiting web that a motion-limiting surface 12 on plastic rail section 4 rests against when the casement is closed. The FIGURE illustrates the closed position. Plastic rail section 4 is also angular and has an outer flank 13 that secures the window pane 14 in the casement.

The window illustrated in the drawing has a antechamber 15 that is demarcated toward the inside by a surrounding strip 16 of sealing material. Strip 16 is secured by an attachment foot 17 in a C-shaped anchoring recess 18. Anchoring recess 18 consists of parts of metal rail section 6 and of parts of plastic rail section 3. The floor of anchoring recess 18 consists partly of one anchoring web 5 on the plastic rail section.

Strip 16 of sealing material has a sealing lip 19 that rests against a motion-limiting web 20 on metal rail section 7 when the casement is closed.

It will be evident from the drawing that the frame of both the window opening and of the casement that consists of metal rail sections 6, 7 is located behind the sealing plane constituted by strips 16 of sealing material as seen from outside.

The connections between plastic rail sections 3 and 4 and metal rail sections 6 and 7 are located in the vicinity of the sealing plane.

To augment the connection between anchoring webs 5 and recess webs 9 and 10 and to increase the resistance to longitudinal displacement between the two rail sections that constitute the composite section, the anchoring webs or the recess webs can have a coating that increases friction and that contains solid particles that will dig into the plastic or into the recess webs when the recess webs conform to the shape of anchoring webs 5 in order to create a positive connection between plastic anchoring webs 5 and light-metal recess webs 9, 10.

To increase the resistance to displacement between the metal rail sections and the plastic rail sections parallel to the length of the composite section, it is also possible to provide teeth extending transversely to the longitudinal axis of the composite section between anchoring webs 5 and recess webs 9 and 10. Anchoring webs 5 can also be provided with a series of recesses extending over the total length of the anchoring webs and into which some of the material of the recess webs can be forced.

The fittings to be anchored in the masonry are secured to the frame of the window opening that consists of metal rail sections 6. The fittings that connect the casement to the window frame are also attached only to the metal rail sections.

It will be appreciated that the instant specification and claims are set forth by way of illustration and not limitation, and that various modifications and changes may be made without departing from the spirit and scope of the present invention.

What is claimed is:

1. A heat insulated window casement and frame construction comprising: a plurality of struts forming a frame and abutting casement, wherein the struts comprise plastic rail sections on the side thereof facing outwardly and metal rail sections on the side thereof facing inwardly and means connecting the plastic and metal rail sections for the casement and frame struts including recesses in the metal rail sections and anchoring webs on the plastic rail sections secured in the recesses; connecting fittings only connected to metal rail sections; means forming an antechamber between the plastic rail sections of the frame and casement struts including a strip of sealing material contacting the frame and casement and demarcating the antechamber at one side toward the inside to define a sealing plane and means mounting the sealing strip comprising an attachment foot on the strip and means, including the plastic and metal rails of the window frame, forming a C-shaped anchoring recess receiving the attachment foot and having the base portion thereof formed by one anchoring web of the plastic rail section; and wherein the means connecting the metal and plastic rail section are disposed in the vicinity of the sealing plane and the metal rail sections are disposed behind the sealing plane as seen from outside.

2. A heat insulated strut for a window casement or frame comprising: a plastic rail section on the side thereof facing outwardly and a metal rail section on the side thereof facing inwardly and means connecting the plastic and metal rail sections including recesses in the metal rail section and anchoring webs on the plastic rail section secured in the recesses; connecting fittings only connected to the metal rail section; means for forming an antechamber between the plastic rail section of a frame and casement strut including a strip of sealing material for demarcating the antechamber at one side toward the inside to define a sealing plane and means mounting the sealing strip comprising an attachment foot on the strip and means including the plastic and metal rail section of the strut forming a C-shaped anchoring recess receiving the attachment foot and having the base portion thereof formed by one anchoring web of the plastic rail section; and wherein the means connecting the metal and plastic rail sections are disposed in the vicinity of the sealing plane and the metal rail section is disposed behind the sealing plane as seen from outside.

* * * * *